United States Patent [19]

Barettella

[11] 4,373,569

[45] Feb. 15, 1983

[54] WINDOW SHADE ROLLER ASSEMBLY

[76] Inventor: Bernard Barettella, 688 Maple Ave., Ridgefield, N.J. 07657

[21] Appl. No.: 194,231

[22] Filed: Oct. 6, 1980

[51] Int. Cl.[3] ..... A47G 5/02

[52] U.S. Cl. ..... 160/263; 160/323 R

[58] Field of Search ..... 160/313, 315, 318, 319, 160/323 R, 324, 325, 326, 263

[56] References Cited

U.S. PATENT DOCUMENTS

| | | | |
|---|---|---|---|
| 473,990 | 5/1892 | Wilkenson | 160/323 R |
| 698,620 | 4/1902 | Baker | 160/315 |
| 870,876 | 11/1907 | Fleming | 160/323 R |
| 1,203,455 | 10/1916 | Baker | 160/325 |
| 1,729,133 | 9/1929 | Shonnard | 160/313 |
| 3,115,927 | 12/1963 | Znamirowski | 160/323 R |
| 3,448,943 | 6/1969 | Herou | 160/313 |
| 3,853,170 | 12/1974 | Barettella | 160/323 R |

*Primary Examiner*—Peter M. Caun

*Attorney, Agent, or Firm*—Weingram & Klauber

[57] ABSTRACT

A window shade roller adapted for mounting by frictional engagement within the periphery of a window frame, or alternatively, by hang-mounting at receiving brackets on the window frame. The roller has one shaft projecting from a recess in one end that terminates in a spring-loaded pintle to enable raising and lowering the shade, and a spring-loaded second shaft extending through a cap closing a recess in the other end of the roller also terminating in a mounting pintle. The second shaft is selectively movable between a first retracted position so that only the pintle projects through the cap enabling hang-mounting of the shade, and a second telescoped position in which the roller may be frictionally secured within the window frame by placing friction members over the pintles.

10 Claims, 9 Drawing Figures

WINDOW SHADE ROLLER ASSEMBLY

BACKGROUND OF INVENTION

This invention relates generally to window shade rollers and apparatus, and more specifically relates to a window shade roller assembly which is adapted for mounting either within the periphery of a window frame border by frictional engagement therewith, or by conventional hang-mounting upon brackets affixed to the said window frame.

In the most common form of window shade roller assemblies, a pair of mounting pintles extend from opposed ends of the roller and are received into mounting brackets, which are affixed to the window frame. Commonly, one of the said pintles is of flattened or otherwise is of other than round cross-section, and is received into a correspondingly shaped opening at one of the said brackets, whereby the axle or shaft to which such pintle is secured is restrained against rotation. The shaft associated with this pintle thus extends within the window shade roller, and is associated with a winding spring. The other pintle is commonly of rounded cross-section, whereby when it is received at the opposed bracket in a corresponding round opening, it may freely rotate. A ratchet and pawl arrangement is provided at the shaft member, and as the shade is lowered, the mentioned spring is wound, so that a biasing force is generated which will restore the shade to a desired position upon the pawl and rachet being disengaged.

It has long been recognized that window shade mounting arrangements, as aforesaid, while common and generally very acceptable, can be undesirable, in requiring the use of the aforementioned mounting brackets, which damage and deface the walls of the rooms wherein the brackets are mounted. This is particularly a problem in connection with apartment dwellings, where relatively frequent changing of occupants necessitates repeated removal and installation of brackets. Also, of course, once the said brackets are installed, they are not readily moved, which presents a problem when changes are desired, as in redecorating or so forth. Further, in many modern buildings the window frames are of steel or aluminium, making it difficult to install brackets at all. In addition, once installed in such brackets, a shade roller can easily slide from side to side and often becomes disengaged from the brackets.

The above problems have long been recognized, and from time to time proposals have been made for window shade roller assemblies which are based upon frictional mounting, including by spring-biased friction caps. A device of this type is shown in a very old patent to Wilkinson, U.S. Pat. No. 473,990.

Heretofore, however, despite the above difficulties, it has not been generally contemplated that a roller assembly could be produced which was suitable of uses in both of the aforementioned ways.

In my prior U.S. Pat. No. 3,853,170, I disclose a shade roller apparatus for use in connection with a shade roller which is partially directed to the above discussed problem. The apparatus of that said patent, in particular, is adapted to the type of alternate mounting above discussed, i.e., either by a mounting technique based upon frictional engagement within a window frame, or by being secured to conventional brackets on the outside of the window frame. In such device, the axle of the apparatus is thus biased by a spring when frictional mounting is desired. Further, in those instances where conventional bracket mounting is desired, the axle can be retracted. In order to effect this action, however, it is necessary to physically remove the assembly from the shade roller, remove a twist-lock closing member, and thereupon remove the said spring. This series of operations is cumbersome; and, indeed, generally impractical, especially for the usual consumer who desires to make use of such apparatus.

In accordance with the foregoing, it may be regarded as an object of the present invention, to provide shade roller apparatus which is adapted for mounting by either frictional engagement within a window frame periphery, or alternatively, by hang-mounting at receiving brackets on the window frame.

It is a further object of the present invention, to provide apparatus of the above character, wherein the alternate mounting described is effected by a simple externally-actuated change in the shade roller assembly, which change in configuration may be effected by unskilled personnel in rapid and simple fashion.

SUMMARY OF INVENTION

Now in accordance with the present invention, the foregoing objects, and others as will become apparent in the course of the ensuing specification, are achieved in a cylindrical window shade roller assembly which is adapted for mounting either by frictional engagement within the periphery of a window frame, or alternatively, by hang-mounting at receiving brackets on the window frame.

The assembly comprises in combination a cylindrical window shade roller having first and second axial recesses respectively at the opposed ends thereof. A projecting first shaft terminating in a first mounting pintle, is mounted in the first recess to enable rotation of the shade roller during raising and lowering of the associated shade, together with spring means which are wound during said rotation for biasing the roller to enable return to its unwound or initial position.

A two-way mounting assembly is received at the second axial recess. This mounting assembly comprises a hollow, cylindrical housing which is adapted for receipt in the second axial recess, and which terminates in a cap portion which closes the second end of the shade roller.

A second shaft extends centrally through the aforementioned cap into the cylindrical housing. The externally facing distal end of this shaft terminates in a second mounting pintle. Spring-means extend within the housing and bear against a rearward closing for same. A hollow, cylindrical link is provided within the housing between the shaft and spring-means. This link is closed at the end thereof toward the spring, and open at its other end. At such open end, the link receives the rearward portion of the second shaft. The second shaft is selectively moveable between a first longitudinal position where it is retracted within the link, and a second longitudinal position whereat the shaft is telescoped and detented at the link. The shaft is rotatable with respect to the housing at both first and second positions. At the first, i.e., retracted position, the shaft rotates within the link, at the second, i.e., telescoped position, the shaft and link rotate as a unit.

When the second shaft is within its first, or retracted position, substantially only the pintle projects through the cap, to enable hang-mounting of the window shade assembly via this pintle and the pintle provided at the end of the first shaft. When the second shaft is in its telescoped position, the window shade assembly may be frictionally secured within the window frame border by securing friction members over the pintles, positioning the friction member of the end of the first shaft in mechanical engagement with one side of the window frame, moving the second shaft inwardly to compress the spring and placing the window shade assembly within the frame, and thereupon permitting the restorative force of the spring to expand the second shaft (and thereby the friction member) against the window frame to effect frictional engagement therewith.

The aforesaid friction members are adapted for respective mounting at the pintles formed at the end of the first and second shafts. These members have outwardly facing surfaces having a high coefficient of friction to enable engagement of the window frame border when the second shaft is in its extended position, i.e., when the aforementioned spring thereupon forces the second shaft outwardly to effect the compressive engagement of the overall assembly within the frame.

The second shaft toward the rearward portion thereof, carries oppositely directed pins extending from its lateral surface. When the shaft is in its telescoped or extended position, these pins (which can be the ends of a single pin passing through the shaft) are receivable into detents cut into the wall of the cylindrical link at the edge of the open end thereof.

A pair of release slots extend longitudinally through the wall of the cylindrical link, from the said open end thereof, for a short distance. Rearward of these slots, the wall is undercut, i.e., the wall of the link is thinned. Thus, and in order to move the second shaft from its extended, detented position to its rearward or retracted positon, the operator need only effect a slight rotation of the shaft to align the pins from the detented position and align the pins with the slots, which permits the shaft to withdraw into the portion of the cylindrical link having the thinned or undercut walls. The shaft is then free to rotate. The operator need only provide a slight externally manipulated movement of the shaft to displace same from the extended to the withdrawn position. Similarly, a reversal of this action, effects movement of the said shaft to the extended position.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
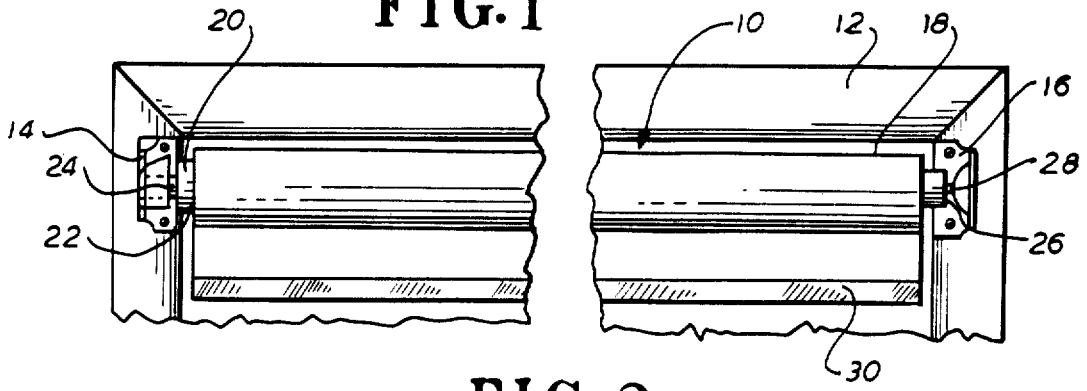
FIG. 1 is an elevational view, which is partially broken to permit foreshortening, of a window shade roller assembly in accordance with the present invention, installed in a conventional hang-mounting arrangement on brackets at a window frame.

In FIG. 1 herein, an elevational plan view appears of a window shade roller assembly 10 in accordance with the invention. The view is broken and foreshortened in order to permit the entire showing to be made in a single Figure. In the showing of FIG. 1, assembly 10 is installed upon a window frame 12 by being hung-mounted in conventional brackets 14 and 16 which are secured to alternate sides of the window frame.

Figure 4:
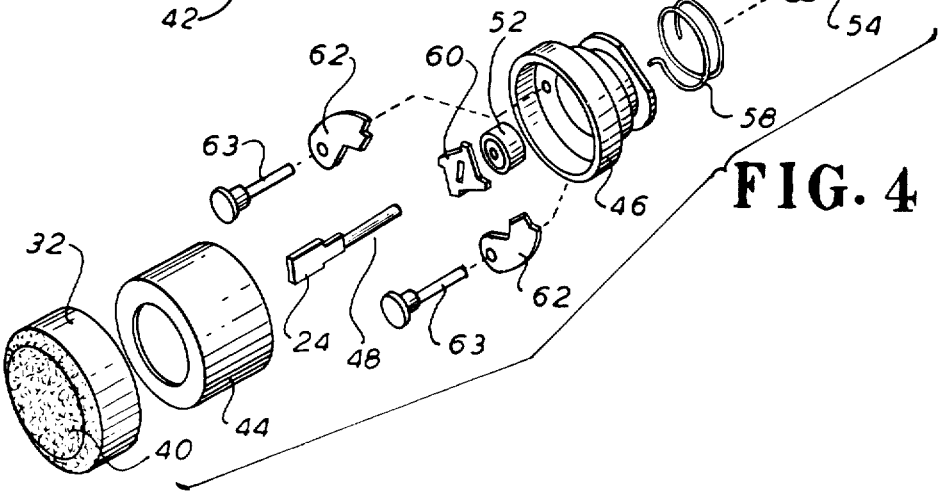
FIG. 4 is an exploded perspective view of the end assembly appearing in FIG. 3.

In this instance, assembly 10 is actually shown with a conventional window shade 18 is secured thereto, in order that the total arrangement of apparatus might be better appreciated. In any event, it is seen that at the left or first end 22 of the window shade roller 20, a pintle 24 projects, which as can be better seen in FIG. 4, is of flattened shape and rectangular cross-section. This pintle 24 is conventional, and is received in a corresponding opening in conventional bracket 14. The object, of course, is that once so received, it is constrained against rotation. At the opposed or second end 26 of roller 20, a further pintle 28 projects. This corresponds to the same element better seen in FIGS. 5 and 6. This pintle 28 is of simple round cross-section and in that sense is conventional, and is received at bracket 16 into either a round opening or a U-shaped channel which is rounded at the bottom. In any event, it is not constrained, but can rotate as the shade end 30 is displaced upwardly or downwardly.

Figure 2:
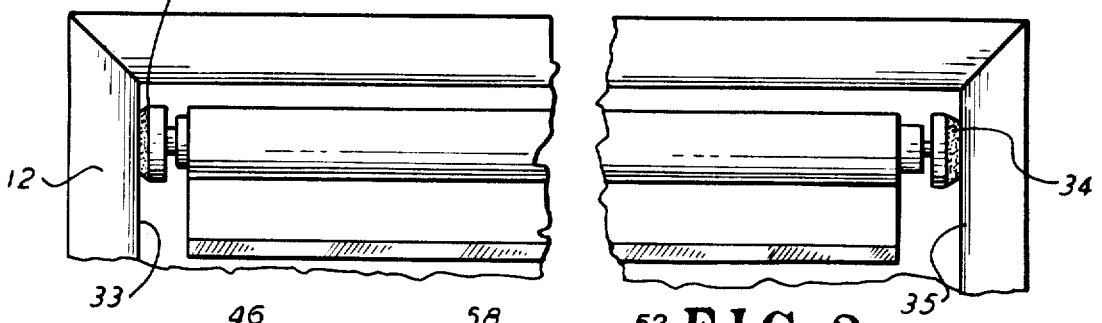
FIG. 2 is an elevational view similar to FIG. 1, but showing the aforementioned assembly mounted via frictional engagement within the periphery of the same or a similar window frame.
Figures 5, 6, 7, 8:
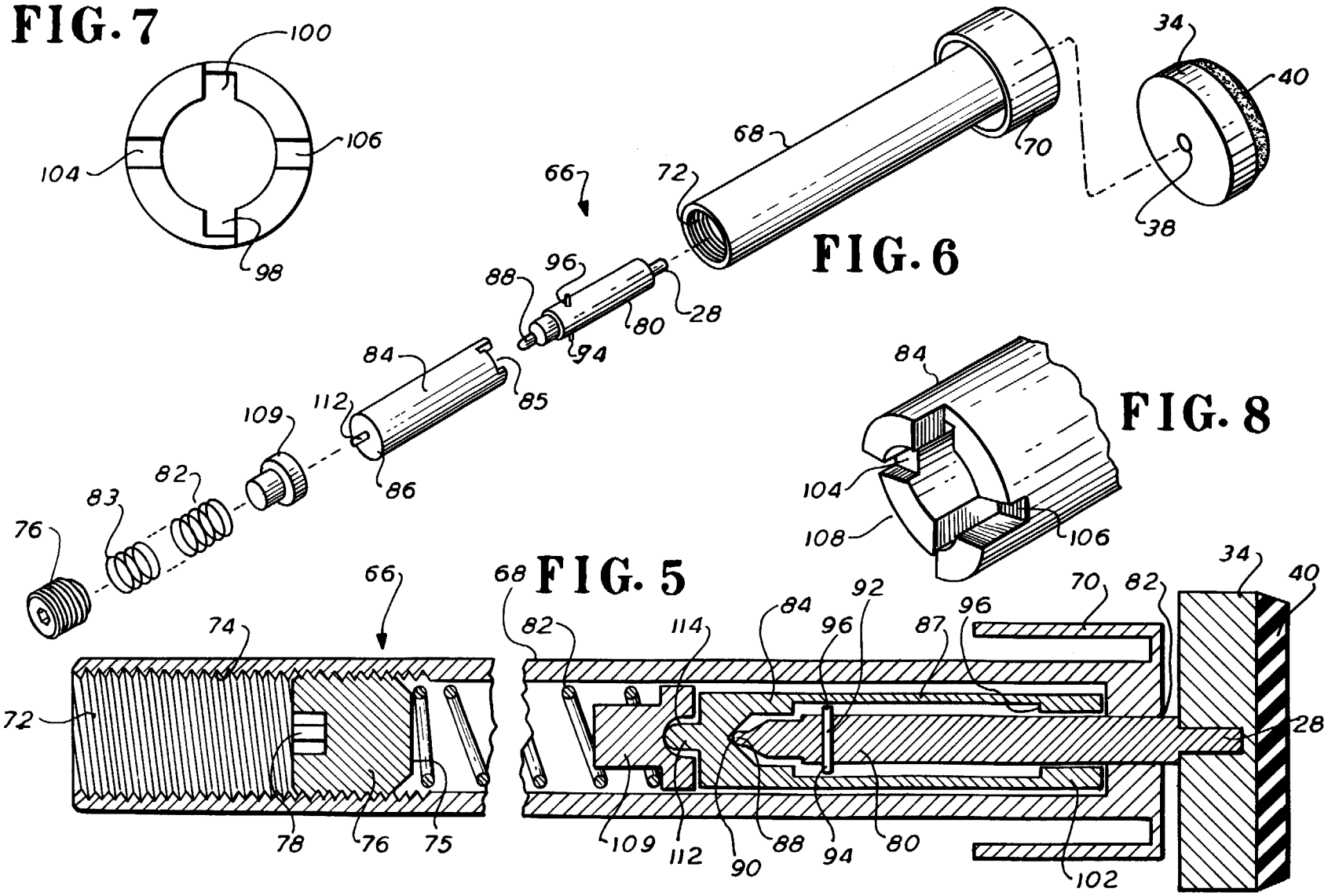
FIG. 5 is a longitudinal cross-sectional view of the two-way mounting assembly, which in accordance with the invention, is utilized at the alternate end of the window shade roller.
FIG. 6 is an exploded perspective view of the two-way assembly shown in FIG. 5.
FIG. 7 is a right-end view of the cylindrical link portion of FIG. 6.
FIG. 8 is a perspective view of the same end of the aforementioned link which appears in FIG. 7.
Figure 9:
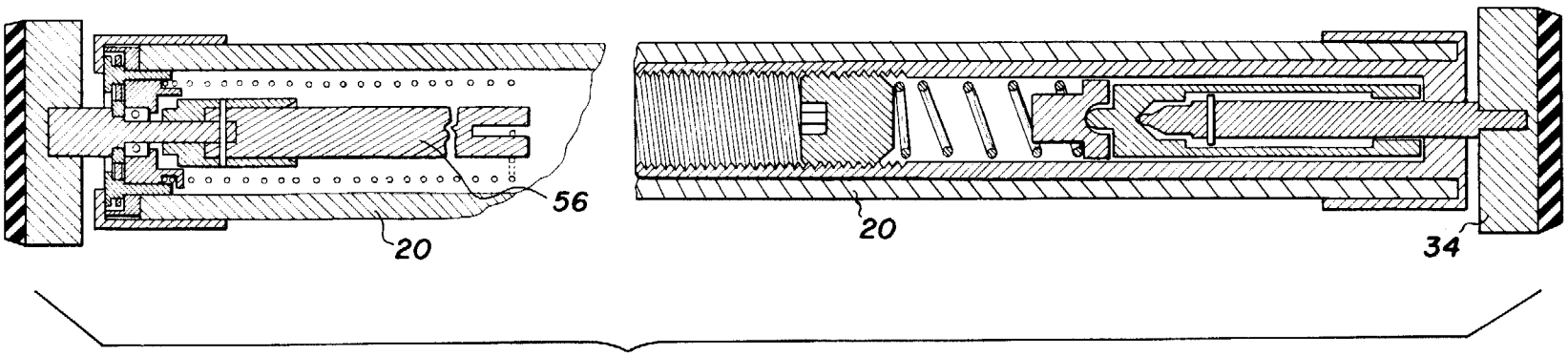
FIG. 9 is a vertical cross-sectional view of the roller showing the internal end structures of the complete device.

In FIG. 2, the same basic apparatus as in FIG. 1 is shown, except in this instance a pair of friction members 32 and 34 have been seated upon the pintles 24 and 28. These elements are better seen in FIGS. 4 and 6. They are provided at their sides which are secured to the pintle, with openings having corresponding cross-sections to that of the respective pintle. Thus as seen in FIG. 6, a recess 38 of round cross-section is provided. A similar recess, but of rectangular cross-section is provided (but not shown) for member 32.

The outwardly facing surfaces of members 32 and 34 are covered with a layer 40 of a material having a high coefficient of friction, as, for example, a sponge rubber or the like. In use, face 35 of frame 12, and assembly 10 is pushed to the right against a spring 82 (see FIGS. 5 and 6 described below). Assembly 10 is thereupon eased within the border of frame 12, and the shaft upon which member 32 is mounted is permitted to expand (via the restorative spring) against face 33 of frame 12, to enable the frictional mounting shown in FIG. 2.

Figure 3:
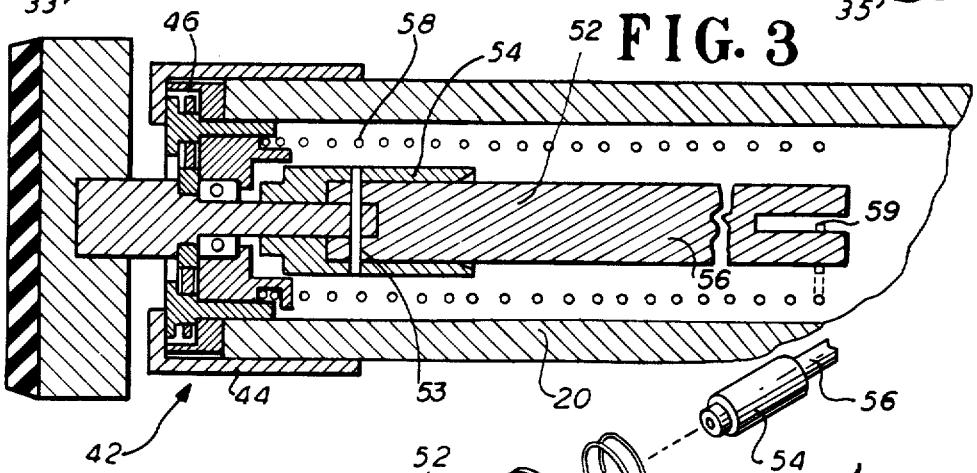
FIG. 3 is a cross-sectional end view of one end of the window shade roller assembly, i.e., the end including the rewind assembly.

In FIGS. 3 and 4, longitudinal cross-sectional and exploded perspective views appear of the end mounting assembly 42 which is secured within an axial opening or recess provided at the left or first end of roller 20. The roller 20 is, of course, generally conventional, and may be formed of wood or other material. Assembly 42 includes a cap 44 which secures the remainder of the assembly to roller 20. Cap 44 overlies and retains in place a housing 46 through the central opening of which passes the pintle piece 48 the outward end of which is formed into the pintle 24 as aformentioned.

It is preferred in accordance with the present invention, and in contra-distinction to prior art, to utilize a bearing 52 for rotatably supporting the pintle piece 48 with respect to housing 46. The pintle piece 48, in turn, is secured by pins 53 to a metal end cap 54, which is secured to the spring guide shaft 56. A conventional winding spring 58, is mounted about the shaft 56 and secured at one end to slot 59, and at the other end, (by pins) to housing 46. In the present arrangement, the bearing 52 is important, and may constitute a roller bearing or bearing or other known type, including of self-lubricating plastic such as PFTE (e.g., "Teflon") or so forth. Such bearing is particularly significant when the present assembly is arranged as in FIG. 2, in that the high compression applied along the roller tends to generate forces which can provide a degree of sticking where conventional mounting arrangements are used for the shaft of assembly 42, i.e., in such conventional arrangements, substantially no friction-reducing bearing is provided.

The usual rachet 60 and pawls 62 (secured by pins 63) are also provided, again as known in the art, in order to enable release of the spring 58 once the latter is wound. In general, it will be appreciated that except for the use of the unusual bearing arrangement in connection with assembly 42, the function carried out by assembly 42 is conventional in prior art shade apparatus; i.e., it is intended to enable rotation of the shade roller about the shaft which can be regarded as constituted by pintle piece 24 and the extension thereof which includes cap 54 and guide shaft 56.

In FIGS. 5 and 6, cross-sectional and perspective views appear of the two-way mounting assembly 66 which is received into the axial recess which is present at the right-hand or second end 26 of roller 20.

Assembly 66 is seen to comprise a hollow, cylindrical housing 68, one end of which terminates in a cap 70 which is fitted over and closes the second end 26 of shade roller 20. The opposite, more generally open end 72 of housing 68 is seen to be internally threaded as at 74, for a longitudinal distance which can vary. The said open threaded end 72 can thus receive a correspondingly threaded plug 76, which is provided with a recess 78 of octagonal or other cross-section for receiving a wrench to enable rotation of plug 76 to achieve a given longitudinal position within housing 68. A second shaft, generally designated at 80, extends centrally through the opening 82 in cap 70. The externally facing distal end of shaft 80 terminates in the mounting pintle 28 which has previously been discussed. This pintle 28, also as has been discussed, may receive the friction member 34 if a mounting as in FIG. 2 is desired.

Spring-means 82 are seen to further extend within housing 68. The rearward end 83 of the spring means bear against the adjacent surface 75 of plug 76 which moves longitudinally within threaded portion 74 of housing 68. The longitudinal position of plug 76 can be adjusted to vary the tension on spring means 82 and also to provide a stop limiting the rearward movement of shaft 80 via link 84. Thus, as the plug moves to the right, end 85 of the link which receives rounded bearing surface 88 of the shaft moves the shaft to the right which places end 28 into the open end 72 of the housing limiting movement of the shaft. This assures clearance between housing 68 and member 34.

A hollow, cylindrical link 84 is present within housing 68, between the shaft 80 and spring-means 82. This link 84 is seen to be closed at the end 86 thereof, which is toward the spring-means 82, and is open at its other end 85. At such open end 85, the link 84 receives the rearward portion of second shaft 80.

In the showing of FIG. 5, the shaft 80 is seen to be positioned in its first or retracted position within the link 84. It is noted that in this position the rearward end of shaft 80, which is formed into a rounded bearing-like surface 88, is received at the recessed bottom 90 of link 84. Further to be noted is that a cross piece 92 passes transversely through shaft 80 and defines projecting pins 94 and 96, i.e., which project laterally at the opposed sides of shaft 80. To be noted, is that the interior of cylindrical link 84 has its wall 87 undercut at points rearward of 96, so that it will be clear that in the configuration shown in FIG. 5, the shaft 80 is free to rotate. While for clarity and full understanding, the friction number 40 is shown in FIG. 5 secured upon pintle 28, it will be apparent that the longitudinal position of shaft 80 in FIG. 5 is actually that adapted for hang-mounting; and accordingly, when shaft 80 is in this retracted position (and the assembly 10 used as in FIG. 1) the member 40 will normally not be used. Clearly, the rotation is desired in order that the roller secured thereto may freely rotate about shaft 80.

When it is desired to extend shaft 80 to its telescoped, outward position for the aforementioned frictional mounting (of FIG. 2), the shaft 80 is moved to the right (in the sense of the drawing) with respect to housing 68. Referring to the end view of FIG. 7, shaft 80 is slightly rotated so that the pin portions 94 and 96 may pass through the release slots 98 and 100 (FIG. 7) which are provided through the end portion 102 of link 84. The shaft 80, i.e., once the pins are passed through the slots, is then slightly rotated and the shaft is then seated via the pin portions 94 and 96 being received in the detents which are provided by grooves 104 and 106 at the end face 108 of link 84. These grooves 104 and 106 are also seen in the perspective view of FIG. 8.

Thus, it will be clear that with the shaft 80 now extended and reseated in its detented position, the shaft is telescoped with respect to link 84. When pressure is subsequently applied to the end of the shaft, as via member 34 being pushed inwardly, such pressure acting through the link 80 will bear against a bearing block 109 in turn seated within the central opening of spring means 82. Thus the spring means will act to provide a restorative force tending to return the shaft to its extended position after same is depressed inwardly.

At the same time, it will be clear that the rounded projection 112 is seated within the facing opening 114 of bearing block 109, so that once again the shaft 80 is free to rotate with respect to the housing 68, i.e., in this telescoped configuration, shaft 80 and link 84 rotate as a unit. Housing 68 is, of course, secured to the roller 20 via suitable fastening means, provided between such roller and cap 70.

While the present invention has been particularly set forth in terms of specific embodiments thereof, it will be understood in view of the present teaching, that numerous variations upon the invention are now enabled to those skilled in the art, which variations yet reside within the scope of the instant teaching. Accordingly, the invention is to be broadly construed, and limited only by the scope and spirit of the claims now appended hereto.

I claim:

1. A cylindrical window shade roller assembly adapted for mounting either by frictional engagement within the periphery of a window frame; or alternatively by being hang-mounted at receiving brackets on the window frame; said assembly comprising in combination:

a cylindrical window shade roller having a first and second axial recesses, respectively at the first and second ends thereof;

a projecting first shaft being mounted in said first recess to enable rotation of said shade roller thereabout during raising and lowering of the associated shade when said assembly is mounted at said window frame, and spring means wound during said rotation for biasing said roller to enable return thereof to its initial position;

a two-way mounting assembly being received at said second axial recess, said mounting assembly comprising:

(1) a hollow cylindrical housing adapted for being received in said second axial recess and terminating in a cap portion having a diameter larger than that of said housing, whereby said cap may close said second end of said shade roller;

(2) a second shaft extending centrally through said cap and into said housing, the externally facing distal end of said shaft terminating in a mounting pintle;

(3) spring means extending within said housing and bearing against a rearward closing thereof;

(4) a hollow cylindrical link within said housing between said shaft and spring means, said link being closed at the end thereof toward said spring and open at the other end thereof, said link receiving at its open end the rearward portion of said second shaft; said shaft being selectively moveable between a first longitudinal position where it is retracted within said link, and a second longitudinal position whereat said shaft is telescoped with respect to and detented at said link; said shaft being rotatable with respect to said housing at each of said first and second positions;

whereby when said second shaft is in said first, withdrawn position, substantially only said pintle projects through said cap to enable said hang-mounting of said window shade assembly; and whereby when said shaft is in said second, extended position, said window shade assembly may be frictionally secured within said window frame border by positioning the end of said first shaft in mechanical engagement with one side of said window frame periphery, moving said second shaft inwardly to compress said spring, emplacing said shade roller assembly within said frame, and permitting the restorative force of said spring to expand said second shaft against said window frame to effect frictional engagement therewith.

2. An assembly in accordance with claim 1, further including a pair of friction members adapted for respective mounting at the distal ends of said first and second shafts; said members having outwardly facing high friction surfaces for engaging said window frame border when said second shaft is in said second extended position.

3. An assembly in accordance with claim 1, further including a bearing block between said cylindrical link and said spring means, for enabling rotation of said second shaft when said shaft is in said telescoped position.

4. An assembly in accordance with claim 3, wherein the rearward portion of said second shaft carries a pair of oppositely directed pins extending from the lateral surface thereof; said pins being receivable into detents cut into the wall of said cylindrical link at the edge of the open end thereof, when said second shaft is in said telescoped position.

5. An assembly in accordance with claim 3, wherein said wall of said cylindrical link includes a pair of release slots extending longitudinally from the open end thereof, for receiving said pins and enabling rearward movement of said second shaft; and wherein said wall is undercut rearward of said slots, to enable rotation of said second shaft at said retracted first position.

6. An assembly in accordance with claim 2, wherein said cylindrical housing is internally threaded; and including a threaded plug for closing the rearward end of said housing by being threadingly received therein; the longitudinal adjusted position of said plug thereby enabling adjustment of the compression of said spring, to adjust the forces urging said friction members against said window frame border upon said assembly being so mounted, and to assure clearance between the friction member engaged by said second shift and said cylindrical housing.

7. An assembly in accordance with claim 2, further including friction reducing bearing means between said first shaft and said shade roller, to facilitate relative rotation therebetween.

8. An assembly in accordance with claim 1, wherein said means is a roller bearing.

9. In a cylindrical window shade roller assembly including a cylindrical window shade roller having an axial recess at the first and second ends thereof; a projecting first shaft being mounted in said first recess to enable rotation of said shade roller thereabout during raising and lowering of the associated shade, when said assembly is mounted at said window frame, and spring means wound during said rotation for biasing said roller to enable return thereof to its unwound position; the improvement enabling said assembly to be mounted either by frictional engagement within the periphery of a window frame; or alternatively by being hang-mounted at receiving brackets on the window frame, comprising:

a two-way mounting assembly being receiving at the axial recess at said second end of said roller said mounting assembly comprising:

(1) a hollow cylindrical housing adapted for being received in said second axial recess and terminating in a cap portion having a diameter larger than that of said housing, whereby said cap may close said second end of said shade roller;

(2) a second shaft extending centrally through said cap and into said housing, the externaly facing distal end of said shaft terminating in a mounting pintle;

(3) spring means extending within said housing and bearing against a rearward closing thereof;

(4) a hollow cylindrical link within said housing between said shaft and spring-means, said link being closed at the end thereof toward said spring and open at the other end thereof, said link receiving at its open end the rearward portion of said second shaft; said shaft being selectively moveable between a first longitudinal position where it is withdrawn within said link, and a second longitudinal position whereat said shaft is telescoped with respect to and dented at said link; said shaft being rotatable with respect to said housing at each of said first and second positions;

whereby when said second shaft is in said first, withdrawn position, substantially only said pintle projects through said cap to enable said hang-mounting of said window shade assembly; and whereby when said shaft is in said second, extended position, said window shade assembly may be frictionally secured within said window frame border by positioning the end of said first shaft in mechanical engagement with one side of said window frame periphery, moving said second shaft inwardly to compress said spring, emplacing said shade roller assembly within said frame, and permitting the restorative force of said spring to expand said second shaft against said window frame to effect frictional engagement therewith.

10. An assembly in accordance with claim 1, further including a pair of friction members adapted for respective mounting at the distal end of said first and second shafts; said members having outwardly facing high friction surfaces for engaging said window frame border when said second shaft is in said second extended position.

* * * * *